United States Patent [19]

Novacek et al.

[11] Patent Number: 4,781,532

[45] Date of Patent: Nov. 1, 1988

[54] BLADE RETENTION FEATURE FOR SADDLE FIR TREE ROOT BLADES OF TURBO MACHINES AND METHOD OF USING SAME

[75] Inventors: Peter Novacek, Gebenstorf; Paul Slepcevic, Nussbaumen; Toni von Arx, Trimbach, all of Switzerland

[73] Assignee: BBC Brown, Boveri & Company, Ltd., Baden, Switzerland

[21] Appl. No.: 869,920

[22] Filed: Jun. 3, 1986

[30] Foreign Application Priority Data

Jun. 28, 1985 [CH] Switzerland ..... 2767/85

[51] Int. Cl.[4] ..... F01D 5/32

[52] U.S. Cl. ..... 416/222; 416/217; 29/156.8 R; 29/433

[58] Field of Search ..... 416/190, 191, 222, 217, 416/216; 29/156.8 R, 433

[56] References Cited

U.S. PATENT DOCUMENTS

| | | | |
|---|---|---|---|
| 1,279,800 | 9/1918 | Warriner | 416/222 X |
| 1,415,266 | 5/1922 | Rice | 416/222 X |
| 2,036,083 | 3/1936 | Robinson | 416/222 X |
| 2,103,905 | 12/1937 | Hillner | 416/222 X |
| 2,157,827 | 5/1939 | Kliemann | 416/222 X |
| 2,199,243 | 4/1940 | Mortimer | 416/222 X |
| 2,221,685 | 11/1940 | Smith | 416/191 |
| 2,315,616 | 4/1943 | Hall | 416/222 X |
| 2,844,355 | 7/1958 | Rankin | 416/222 X |
| 3,826,592 | 7/1974 | Raboin | 416/222 |

FOREIGN PATENT DOCUMENTS

| | | | |
|---|---|---|---|
| 148907 | 11/1979 | Japan | 416/222 |
| 39905 | 3/1984 | Japan | 416/222 R |
| 208104 | 11/1984 | Japan | 416/222 |
| 532372 | 1/1941 | United Kingdom | 416/222 |
| 572090 | 9/1945 | United Kingdom | 416/222 |
| 875412 | 8/1961 | United Kingdom | 416/222 |

*Primary Examiner*—Everette A. Powell, Jr.

*Attorney, Agent, or Firm*—Burns, Doane, Swecker & Mathis

[57] ABSTRACT

In the case of saddle-type rotor blades of axial-flow turbomachines, the locking blade (6*a*), without its root part engaging in the fir trees (2) on the radially outer part of the rotor disk (1), is located under a large prestress between its neighboring blades (6*b*, 6*c*). It is fastened in the root part by means of axial pins (7). The blade root (4') of the locking blade (6*a*) is dimensioned more narrowly in the region of its fir trees (2') in its axial extension than that (4) of the neighboring blades (6*b*, 6*c*). By this means, a removal recess (10) is produced on both the inlet and outlet sides, in each of which a compression jack (11) can be introduced for pressing apart the neighboring blades (6*b*, 6*c*). The locking blade, relieved of loads in this manner, can be removed without being destroyed.

6 Claims, 2 Drawing Sheets

BLADE RETENTION FEATURE FOR SADDLE FIR TREE ROOT BLADES OF TURBO MACHINES AND METHOD OF USING SAME

The invention relates to a blade retention feature for saddle-type rotor blades of axial-flow turbomachines in which the locking blade, without its root part engaging in the fir trees on the radially outer part of the rotor disc, is located under a large prestress between its neighboring blades and is fastened with the latter in the root part by means of axial pins.

BACKGROUND OF THE INVENTION

An insertion opening, which is generally closed by a locking blade, is required for the mounting of saddle-type rotor blades, which are often used in turbomachines with disk rotors. The locking blade is usually fastened by riveting the locking blade, or by the use of axial fixing pins. In order to ensure that the saddle fir tree root blades are seated without play in the peripheral direction during operation, the blades are mounted with prestress in the peripheral direction. The prestress selected, or operational effects, can have the result that removing the blades is only possible by destroying the locking blade.

OBJECTS AND SUMMARY

The object of the present invention is, therefore, to produce a blade retention feature, of the type mentioned at the beginning, such that the locking blade can be removed without being destroyed.

This is achieved, according to the invention, by making the blade root of the locking blade more narrowly dimensioned in the region of its fir trees in its axial extension than that of the neighboring blades. As a result, a removal recess is produced on both the inlet and outlet sides, in which recess a compression jack can be introduced for pressing part the neighboring blades.

When these blades are being pressed apart, pressures of some 1000 bar may be necessary in order to unload the locking blade sufficiently for it to be withdrawn radially from the blade group. The auxiliary surfaces for transmitting these forces have to be correspondingly dimensioned.

DESCRIPTION OF THE DRAWING

An exemplary embodiment of the invention is shown diagrammatically in the drawings. In this.

DESCRIPTION OF THE INVENTION

Figure 1:
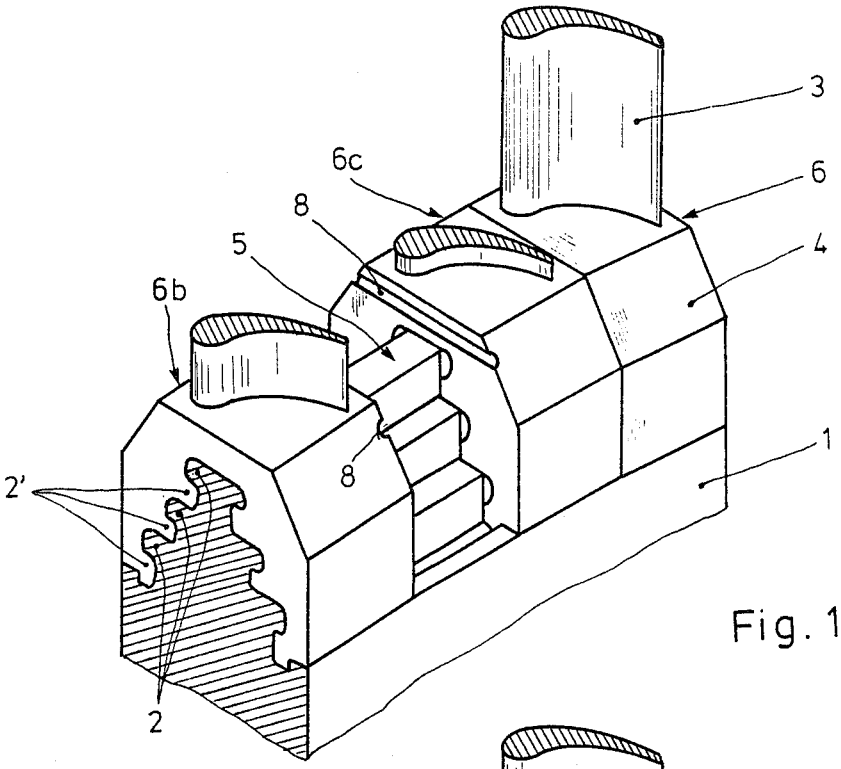
FIG. 1 is a perspective view of part of a turbine before the locking blade is mounted.

In the case of the turbine part shown only in its essential elements necessary for understanding the invention, the bladed disk rotor is that of a steam turbine. The disk 1 is provided in its radially outer periphery with overlapping fir trees, or lugs, 2. Their supporting crosssection narrows in the direction of decreasing force. The rotor blades 6, consisting of the blade airfoil 3 (partially shown), shroud 13 (FIG. 3) and blade root 4, are fed saddle-wise onto the disk in the peripheral direction and fastened. For this purpose, the inner hollow sides of the blade roots are provided with corresponding fir trees 2'.

An insertion opening 5 is provided at one point on the periphery of the disk for blading or for removing the blades. This opening has substantialy the width of a blade root in the peripheral direction and is produced simply by machining away the ends of the fir trees 2. The locking blade **6*a* is placed radially over the insertion opening 5 and is held with its neighboring blade 6*b* and 6*c* by means of an axial pins 7. The holes 8 necessary for this purpose are roughly machined previous to the mounting of the blades and are finally reamed after mounting is completed. The fitted pins 7 are not riveted on both sides but are only calked. It is obvious that, if necessary, the next adjacent blades can also be in effective connection with the neighboring blades 6*b* and 6*c*** by means of axial pins.

Figure 3:
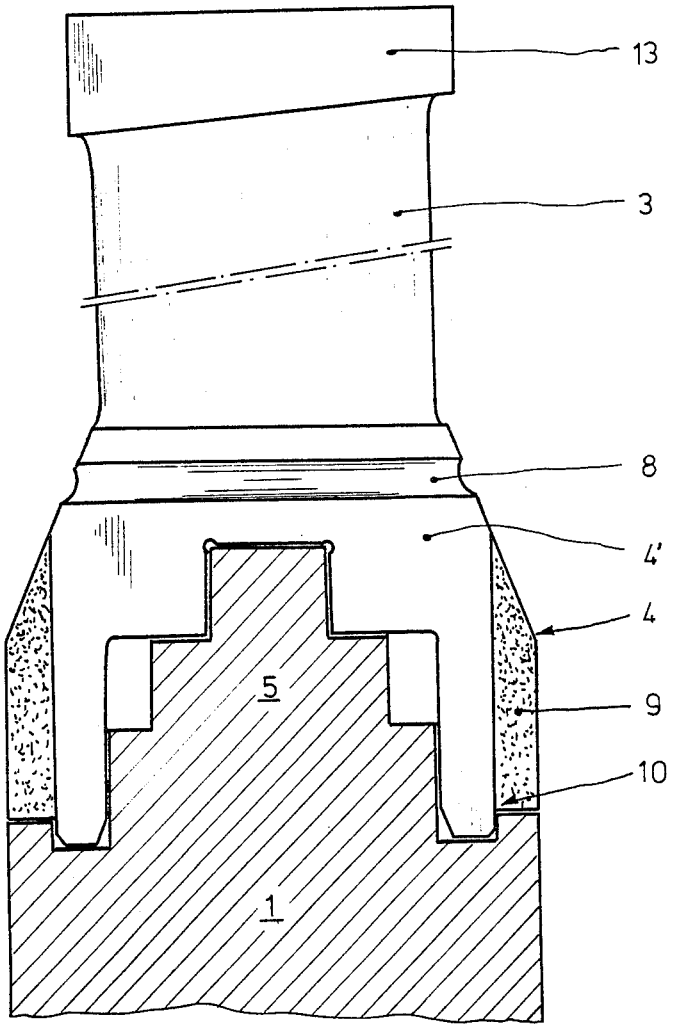

It may be seen from FIG. 3 that the locking blade **6*a*, when placed in position, can only be guided laterally on the upper and lower flanks of the stepped insertion opening 5. In its axial extension, the blade root 4' is dimensioned more narrowly than that (4) of the neighboring blade 6*c* behind it. This produces an auxiliary surface 9** (shown dotted), against which a tool can be placed.

Figure 2:
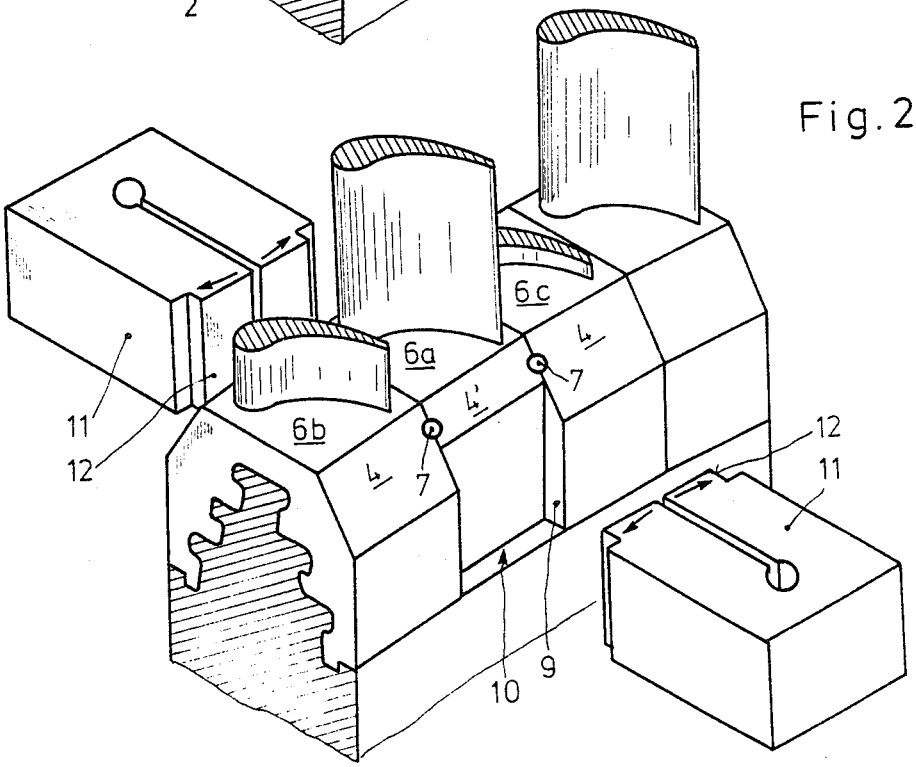
FIG. 2 is the same view with the locking blade mounted and, FIG. 3 is an axial cross-section through the insertion opening of the wheel disk with, in end view, the locking blade placed in position.

The outer flanks of the locking blade root 4' thus form, together with the auxiliary surfaces 9 of the neighboring blades **6*b* and 6*c*, recesses 10 (FIG. 2**). These recesses are provided on both sides of the disk, i.e. on the inlet side and the outlet side relative to the flow direction of the working medium.

In order to remove the locking blade, compression jacks 11 are inserted on both sides into the recesses 10. These compression jacks, which are only shown diagrammatically in FIG. 2, are preferably hydraulically actuated. Their compression heads 12 are in contact with the auxiliary surfaces 9 of the neighboring blades **6*b* and 6*c* and press these apart in the direction of the arrows. In order to overcome the substantial prestress to which the blade pack is subjected and in order to release from their seating blades which may possibly be jammed, it is necessary, under certain circumstances, to apply pressures of the order of some 1000 bar. After the removal of the fastening pin 7, the locking blade 6*a***, from which the loads have now been removed, can be withdrawn without any difficulty.

While this invention has been illustrated and described in accordance with a preferred embodiment, it is recognized that variations and changes may be made therein without departing from the invention as set forth in the claims.

What is claimed is:

1. In a saddle-type rotor blade axial-flow turbomachine having a plurality of blades mounted on blade roots, said blade roots engaged with lugs on a rotor disk, and a locking blade mounted on a locking blade base, the improvement comprising:

said locking blade base being located between adjacent blade roots under a prestress;

means for fastening said locking blade base to the adjacent blade roots; and said locking blade base being dimensioned axially more narrowly in the region of the lugs of the rotor disk than that of the adjacent blade roots in such a way that a first removal recess is formed on one side of the locking blade base exposing walls on the adjacent blade roots adapted to receive pressure from a prestress relieving tool.

2. The turbomachine of claim 1, wherein the fastening means includes axial pins.

3. The turbomachine of claim 1, wherein the prestress in the locking blade base is at least 1000 bar.

4. The turbomachine of claim 1, wherein a second removal recess is formed on a side of the locking blade base opposite the first removal recess.

5. In a saddle-type rotor blade axial flow turbomachine having a plurality of blades mounted on blade roots, said blade roots engaged with lugs on a rotor disk and a locking blade mounted on a locking blade base, said locking blade base arranged between adjacent blade roots under a prestress and fastened to the adjacent blade roots with fasteners, wherein said locking blade base is dimensioned axially more narrowly in the region of the lugs than the adjacent blade roots in such a way that a removal recess is formed on one side of the locking blade base, a method of removing the locking blade comprising:

inserting a jack into the removal recess;

applying a force with the jack to the adjacent blade root surfaces defined by the recess so as to urge the adjacent blade roots away from the locking blade base;

removing the fasteners from the locking blade base; and removing the locking blade from the rotor disk.

6. The method of claim 5, wherein the force applied with the jack is at least 1000 bar.

* * * * *